US005266181A

United States Patent [19]

Matsumura et al.

[11] Patent Number: 5,266,181

[45] Date of Patent: Nov. 30, 1993

[54] CONTROLLED COMPOSITE DEPOSITION METHOD

[75] Inventors: Sowjun Matsumura; Tadashi Chiba; Yoshiko Hotta, all of Hirakata; Itsuji Yoshikawa, Toyonaka, all of Japan

[73] Assignees: C. Uyemura & Co., Ltd.; Osaka Cement Co., Ltd., Osaka, Japan

[21] Appl. No.: 971,555

[22] Filed: Nov. 5, 1992

[30] Foreign Application Priority Data

Nov. 27, 1991 [JP] Japan ..... 3-339755
Nov. 27, 1991 [JP] Japan ..... 3-339756

[51] Int. Cl.[5] ..... C25D 15/00
[52] U.S. Cl. ..... 205/109; 427/437
[58] Field of Search ..... 205/109; 427/437

[56] References Cited

FOREIGN PATENT DOCUMENTS 131585 6/1991 Japan .

*Primary Examiner*—T. M. Tufariello
*Attorney, Agent, or Firm*—Birch, Stewart, Kolasch & Birch

[57] ABSTRACT

A composite deposit in which insoluble particles are co-deposited and dispersed in a metal matrix is formed on an article by dipping the article in a metal plating solution having insoluble particles dispersed therein and effecting an electroplating or chemical plating process. By adjusting the specific surface area of insoluble particles to be dispersed in the metal plating solution, the amount of insoluble particles co-deposited in the composite deposit can be controlled. Better results are obtained with insoluble particles having a specific surface area of 10 $m^2/g$ or less.

18 Claims, 2 Drawing Sheets

CONTROLLED COMPOSITE DEPOSITION METHOD

FIELD OF THE INVENTION

The present invention relates to a plating process comprising the steps of dipping an article in a metal plating solution having insoluble particles dispersed therein and forming on the article a composite deposit in which insoluble particles are co-deposited and dispersed in a metal matrix. More particularly, it relates to a method for controlling the amount of insoluble particles co-deposited in the metal matrix.

BACKGROUND OF THE INVENTION

As is well known in the art, composite plating uses composite plating solutions which are nickel and similar metal plating solutions having insoluble particles such as zirconia and alumina dispersed therein. With articles dipped in the solutions, deposition is electrically or chemically induced to form a composite deposit on the article wherein insoluble particles are co-deposited and dispersed in a metal matrix. Typically zirconia or alumina is co-deposited in nickel. The composite deposits serve for various functions including wear resistance, heat resistance and heat insulation, and any desired combination of such functions is accomplished by a choice of particular types of matrix metal and insoluble particles. In order to exert such functions more effectively, it is necessary to control the amount of insoluble particles co-deposited so as to provide an optimum amount of insoluble particles dispersed in the metal matrix.

While it is desired to control the amount of insoluble particles co-deposited in the metal matrix in accordance with a particular application, it is also recently desired to provide a composite deposit with differential functions in that the amount of insoluble particles co-deposited is different between the inside and outside of the deposit. For producing composite deposits having graded functions, it is essential to freely control the amount of insoluble particles co-deposited.

In the prior art, the amount of insoluble particle co-deposited is controlled by various means, such as by increasing or decreasing the amount of insoluble particles dispersed in plating solution or adjusting plating conditions, for example, adjusting the agitation speed of plating solution, adjusting the plating temperature, or in the case of electrodeposition, increasing or decreasing the current density. The adjustment of the amount of insoluble particles dispersed in plating solution has a certain limit in that although an increased amount of particles dispersed generally leads to an increased amount of particles co-deposited, the amount of particles dispersed cannot be increased beyond a practically acceptable level. The adjustment of plating conditions is insufficient to control the amount of particles co-deposited over a wide range.

Therefore, there is a need for a composite plating method capable of effective control of the amount of insoluble particles co-deposited.

SUMMARY OF THE INVENTION

An object of the present invention is to provide a composite plating method for forming a composite deposit having a controlled amount of insoluble particles co-deposited.

Another object of the present invention is to provide a composite plating method capable of effectively controlling the amount of particles co-deposited so that a composite deposit having graded functions may be readily obtained.

A further object of the present invention is to provide a composite plating method which can increase the amount of particles co-deposited.

We investigated the attributes of insoluble particles or fibers that can affect the co-deposition amount when insoluble particles or fibers are co-deposited with plating metal. We have found that the co-deposition amount is affected little by the particle size distribution and surface potential ($\xi$-potential) of insoluble particle or fibers which have been considered preponderate heretofore, but largely by the specific surface area thereof.

As will become evident from the Examples described later, when composite plating is carried out under identical plating conditions using a plating solution having a fixed amount of insoluble particles with a certain mean particle size dispersed, the amount of particles co-deposited increases with a smaller specific surface area of particles and decreases with a larger specific surface area of particles. That is, there is a substantial inverse proportion between the specific surface area of particles and the amount of particles co-deposited. Differently stated, the amount of particles co-deposited can be expected from the specific surface area thereof. Then, by selecting the specific surface area of insoluble particles, the amount of particles co-deposited in a metal matrix can be readily and positively controlled over a wide range.

If an article is sequentially plated in a series of composite plating solutions in which insoluble particles having different specific surface areas are dispersed, there is formed on the article a composite deposit consisting of a corresponding series of composite layers between which the amount of insoluble particles co-deposited is different. In this way, there is readily obtained a composite deposit having graded functions in that the amount of insoluble particles co-deposited is different between the inside and outside.

As mentioned above, when composite plating is carried out under identical plating conditions using a plating solution having a fixed amount of insoluble particles with a certain mean particle size dispersed, the amount of particles co-deposited increases with a smaller specific surface area of particles. We have also found that if the specific surface area of insoluble particles or fibers is reduced to about 10 $m^2/g$ or less as measured by a BET method, the amount of particles co-deposited is drastically increased.

Therefore, according to a first aspect, the present invention provides a composite plating process comprising the steps of dipping an article in a composite plating solution in the form of a metal plating solution having insoluble particles dispersed therein and forming on the article a composite deposit in which insoluble particles are co-deposited and dispersed in a metal matrix. The amount of insoluble particles co-deposited in the composite deposit is controlled by adjusting the specific surface area of insoluble particles to be dispersed in the metal plating solution.

In a preferred embodiment, the article is sequentially plated in a plurality of composite plating solutions in which insoluble particles having different specific surface areas are dispersed, thereby forming on the article a corresponding plurality of composite deposits between which the amount of insoluble particles co-deposited is different.

According to a second aspect, the present invention provides a plating process comprising the steps of furnishing a composite plating solution in the form of a metal plating solution having insoluble particles having a specific surface area of up to 10 $m^2/g$ dispersed therein and forming on an article a composite deposit in which insoluble particles are co-deposited and dispersed in a metal matrix.

Also contemplated is a material in the form of insoluble particles or fibers having a specific surface area of up to 10 $m^2/g$ to be dispersed in a metal plating solution for forming a composite deposit in which the insoluble particles are co-deposited and dispersed in a metal matrix.

Also contemplated is a composite deposit in which insoluble particles having a specific surface area of up to 10 $m^2/g$ are co-deposited and dispersed in a metal matrix.

DETAILED DESCRIPTION OF THE INVENTION

Figure 1:
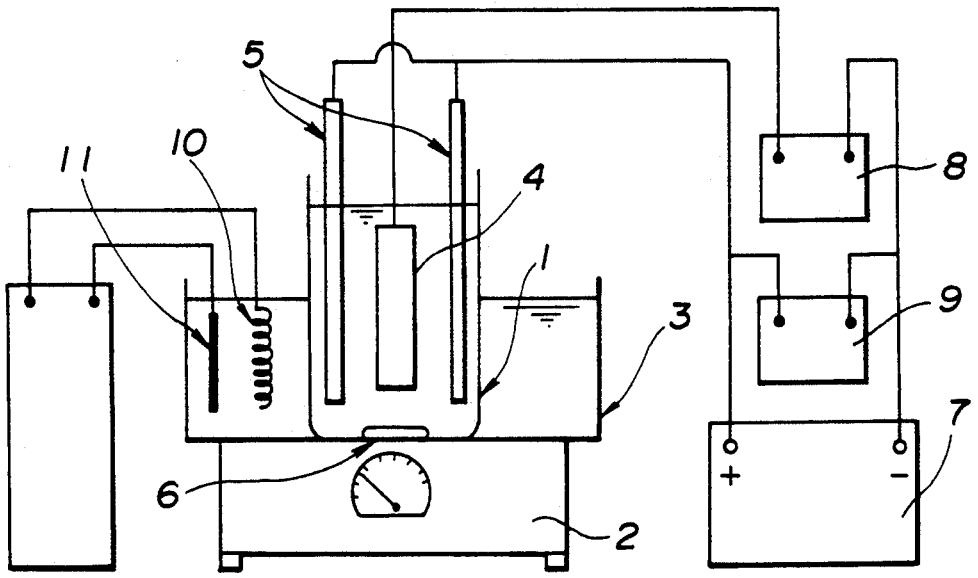
FIG. 1 schematically illustrates a composite plating apparatus used in Examples.

The present invention is addressed to a composite plating process comprising the steps of furnishing a composite plating solution by dispersing insoluble particles in a metal plating solution, dipping an article in the composite plating solution, and causing a composite deposit to form on the article in which insoluble particles are co-deposited and dispersed in a metal matrix. By adjusting the specific surface area of insoluble particles to be dispersed in the metal plating solution, the amount of insoluble particles co-deposited in the composite deposit can be controlled.

Formation of a composite deposit can be effected by either an electroplating process or a chemical plating (electroless plating) process. The metal plating solution which can be used herein includes nickel plating solutions, nickel alloy plating solutions, copper plating solutions, zinc plating solutions, tin plating solutions, tin alloy plating solutions, and the like. These plating solutions may have well-known compositions. Advantageously the present invention is applicable to nickel plating solutions, nickel alloy plating solutions, and copper plating solutions.

The insoluble particles which are dispersed in the metal plating solution include oxides such as zirconia, alumina, silica, titania, ceria, and zinc oxide, composite oxides consisting of at least two of these oxides, carbides such as silicon carbide, tungsten carbide, and titanium carbide, nitrides such as silicon nitride and boron nitride, and organic polymer powders such as fluoro-resin powder, nylon powder, polyethylene powder, polymethyl methacrylate powder, and silicone resin powder. The invention is not limited to these examples, and various other particles and fibers which are insoluble in water may be used.

The present invention is to control the amount of insoluble particles co-deposited by a choice of an adequate specific surface area for the particles. Those particles having a smaller specific surface area are selected when a larger co-deposition amount is desired whereas those particles having a larger specific surface area are selected when a smaller co-deposition amount is desired. The range of specific surface area is not particularly limited in the first aspect of the invention. Preferably the specific surface area ranges from about 0.1 to about 100 $m^2/g$, especially from about 0.5 to about 10 $m^2/g$ as measured by a BET method. For increasing the co-deposition amount, a specific surface area of up to 10 $m^2/g$, especially up to 6 $m^2/g$ is desired.

When an article is plated in a composite plating solution having insoluble particles with a specific surface area of up to 10 $m^2/g$ suspended and dispersed therein, the insoluble particles are compliantly co-deposited in the resulting metal plating film so that there may be obtained a composite deposit having an increased amount of insoluble particles co-deposited. More particularly, a co-deposition amount as high as 20% by volume or more can be readily achieved in an example using zirconia particles as the insoluble particles, which is evident from Examples described later.

The composite deposit having insoluble particles with a specific surface area of up to 10 $m^2/g$ co-deposited therein is characterized by sufficiently increased amount of insoluble particles co-deposited to allow the insoluble particles to exert their function to a maximum extent.

No limit is imposed on the particle size of insoluble particles. Insoluble particles having any desired particle size may be used although the mean particle size preferably ranges from about 0.1 to 20 μm, especially from about 0.2 to 10 μm.

The amount of insoluble particles dispersed in the metal plating solution may vary over a wide range although it is preferably from 5 to 800 grams/liter, especially from 10 to 500 grams/liter. Understandably, since the amount of insoluble particles dispersed in the metal plating solution is one of the factors that dictate the co-deposition amount more or less, preferably it should be also controlled in the practice of the control method of the invention.

Composite plating can take place under any desired set of well-known conditions which may be selected in accordance with a particular type of plating solution and a plating process. For controlling the co-deposition amount, it is also necessary to properly control plating conditions such as agitation mode, agitation speed, plating temperature, and cathodic current density.

According to the co-deposition control method of the present invention, the amount of insoluble particles co-deposited can be changed simply by changing the specific surface area of the insoluble particles. This assures simple attainment of a composite deposit having a desired amount of insoluble particles co-deposited. In one preferred embodiment, an article is sequentially plated in a plurality of composite plating solutions wherein dispersed insoluble particles have different specific surface areas between two adjacent solutions. Then a corresponding plurality of composite layers deposit on the article. The resulting composite deposit possesses a graded function since the amount of insoluble particles co-deposited is different among the inside (adjacent to the substrate), intermediate and outside (remote from the substrate).

EXAMPLE

Examples of the present invention are given below by way of illustration and not by way of limitation.

EXAMPLE 1

A composite plating system was constructed as shown in FIG. 1. A tall beaker 1 for containing a composite plating solution is positioned half-immersed in a constant-temperature bath 3 on a magnetic stirrer 2 equipped with a rotational speed meter. Disposed centrally in the beaker 1 is a cathode 4 in the form of a stainless steel plate (SUS 304, 20×40×0.2 mm). A pair of anodes 5 in the form of electrolytic nickel plates are disposed on opposite sides of the cathode 5. A stirring rod 6 rests on the bottom of the beaker 1 and is adapted to be rotated by the stirrer 2. A DC power source 7 is electrically connected to the cathode 4 and anodes 5 with an ammeter 8 and a voltmeter 9 interposed. A heater 10 and a thermostat 11 both connected to a power source are immersed in the bath 3.

The beaker 1 of the composite plating system was charged with a composite plating solution which was prepared by dispersing zirconia ceramic powder ($ZrO_2$-/$Y_2O_3$ two component system) as identified in Tables 1 and 2 in a nickel sulfamate plating solution containing 1.2 mol/liter of nickel sulfamate, 0.02 mol/liter of nickel chloride and 0.4 mol/liter of boric acid. By operating the stirrer 2 to rotate the stirring rod 6, the solution was agitated for 30 minutes for aging. Then composite plating was performed under the following conditions.

| Plating conditions | |
|---|---|
| Cathodic currecnt density: | 0.5 A/dm$^2$ or 1.0 A/dm$^2$ |
| Particles dispersed: | 400 gram/liter |
| pH: | 3.8 (as prepared) |
| Bath temperature: | 40° C. |
| Stirrer rotation: | 400 rpm |

Figure 2:
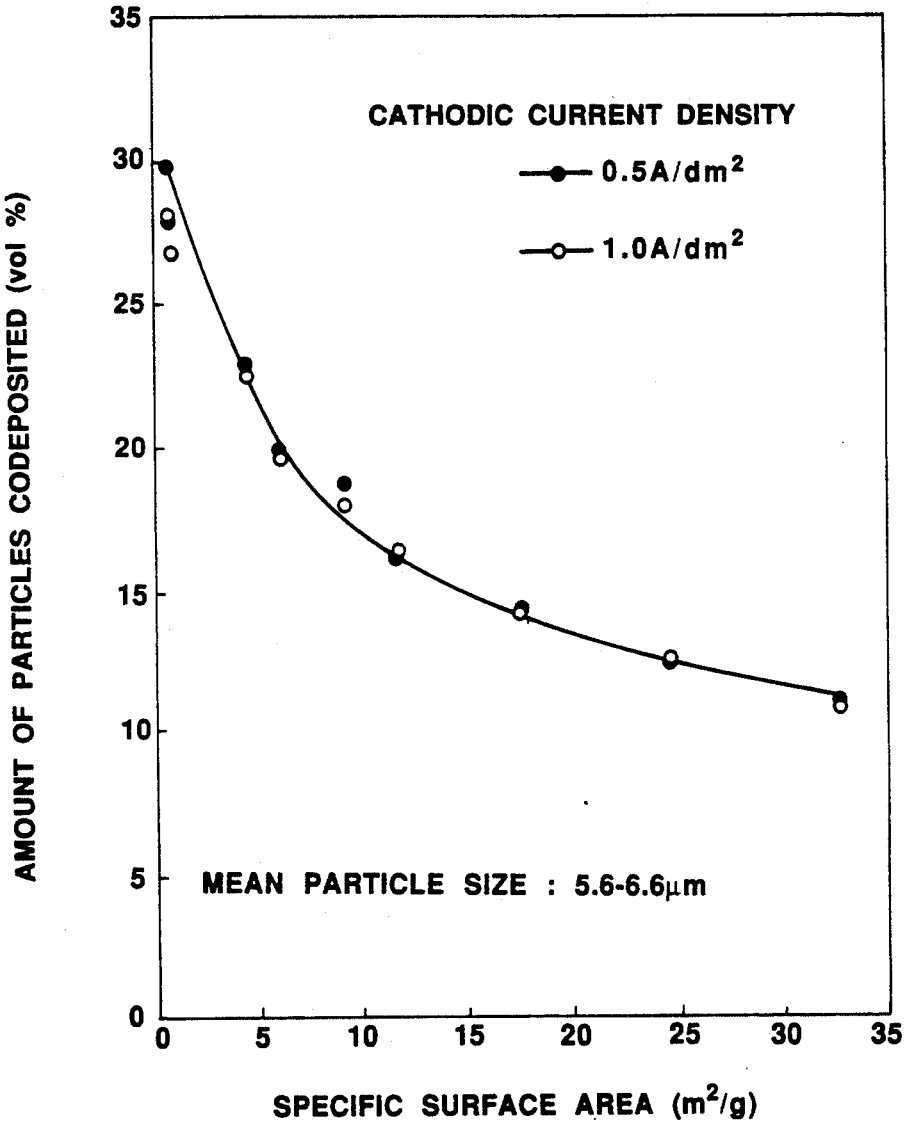
FIG. 2 is a graph plotting the amount of particles co-deposited as a function of their specific surface area, for those zirconia ceramic particles having a mean particle size of 5.6 to 6.6 μm.

The amounts of zirconia ceramic particles co-deposited in the resulting composite deposits are reported in Tables 1 and 2. For those zirconia ceramic particles having an approximately equal mean particle size (listed in Table 1), FIG. 2 shows the amount of particles co-deposited in relation to the specific surface area of particles.

The amount of particles co-deposited was determined by a weight measurement method including measuring the weight of the cathode having a deposit thereon, calculating the weight of the deposit therefrom, then dissolving the deposit with nitric acid, collecting only the particles on a membrane filter, drying the particles, and weighing the particles. The codeposition amount is calculated as volume %.

TABLE 1

| Zirconia ceramic particles | Specific surface area (m$^2$/g) | Mean particle size (μm) | Co-deposition amount (vol %) 0.5 A/dm$^2$ | 1.0 A/dm$^2$ |
|---|---|---|---|---|
| No. 1 | 0.73 | 6.6 | 29.93 | 28.28 |
| No. 2 | 0.80 | 6.6 | 28.01 | 26.85 |
| No. 3 | 3.02 | 5.8 | 26.03 | 25.84 |
| No. 4 | 4.40 | 6.1 | 22.99 | 22.42 |
| No. 5 | 6.10 | 6.1 | 20.01 | 19.54 |
| No. 6 | 9.21 | 6.2 | 18.79 | 18.05 |
| No. 7 | 11.64 | 5.8 | 15.96 | 16.30 |
| No. 8 | 17.49 | 5.6 | 14.21 | 14.20 |
| No. 9 | 24.50 | 6.0 | 12.54 | 12.61 |

TABLE 1-continued

| Zirconia ceramic particles | Specific surface area (m$^2$/g) | Mean particle size (μm) | Co-deposition amount (vol %) 0.5 A/dm$^2$ | 1.0 A/dm$^2$ |
|---|---|---|---|---|
| No. 10 | 32.72 | 6.4 | 11.05 | 10.61 |

TABLE 2

| Zirconia ceramic particles | Specific surface area (m$^2$/g) | Mean particle size (μm) | Co-deposition amount (vol %) 0.5 A/dm$^2$ | 1.0 A/dm$^2$ |
|---|---|---|---|---|
| No. 11 | 3.47 | 1.7 | 25.39 | 24.25 |
| No. 12 | 2.96 | 2.6 | 24.35 | 21.94 |
| No. 13 | 1.92 | 5.0 | 26.18 | 22.06 |
| No. 14 | 3.10 | 9.8 | 26.88 | 24.62 |

As is evident from the data of Table 1, for those zirconia ceramic powders having an approximately equal specific surface area (listed in Table 2), a change in mean particle size resulted in little change in the amount of particles co-deposited. In contrast, for those zirconia ceramic powders having an approximately equal mean particle size (listed in Table 1), a change in specific surface area resulted in a corresponding change in the amount of particles co-deposited as seen from FIG. 2. It was assured that by adjusting the specific surface area of zirconia ceramic powder dispersed in a nickel plating solution, the amount of zirconia ceramic powder co-deposited in nickel matrix could be controlled.

Next, a copper plate was sequentially dipped in three composite plating solutions having zirconia ceramic powders Nos. 10, 6 and 2 dispersed therein, in each of which composite plating was effected at 1.0 A/dm$^2$ for the same time. Sequential deposition resulted in a composite deposit of about 10 μm thick in total.

The composite deposit had a graded function in that it contained about 12%, about 18% and about 26% by volume of co-deposited zirconia ceramic powder in the inside, intermediate and outside layers, respectively. The inside layer having a less amount of particles co-deposited afforded close adhesion to the substrate or copper plate whereas the outside layer having a larger amount of particles co-deposited allowed the particles to exert their own function.

Also, it was found that for those particles having an approximately equal mean particle size, a smaller specific surface area resulted in a larger amount of particles co-deposited. Especially when particles having a specific surface area of up to 10 m$^2$/g were used, the amount of particles co-deposited reached as high as about 20% by volume or higher.

All the zirconia ceramic powders used were of a solid solution consisting of 97.0 mol % of $ZrO_2$ and 3.0 mol % of $Y_2O_3$. Although No. 2 and No. 10 powders had an approximately equal isoelectric point and an approximately equal ξ-potential in nickel sulfamate plating solution, that is, a ξ-potential of +19.2 mV for No. 2 and +20.7 mV for No. 10, a great difference in the amount of particles co-deposited appeared between them. This suggests that the surface potential of particles does not affect the amount of particles co-deposited.

From these findings, it is evident that insoluble particles having a specific surface area reduced to 10 m$^2$/g or less result in a significant increase in the amount of particles co-deposited.

EXAMPLE 2

Composite plating was performed in the same manner as in Example 1 except that the zirconia ceramic powder was replaced by silicon carbide powder shown in Table 3. The amount of particles co-deposited was similarly measured and reported in Table 3.

TABLE 3

| Zirconia ceramic particles | Specific surface area ($m^2/g$) | Mean particle size (μm) | Co-deposition amount (vol %) 0.5 $A/dm^2$ | 1.0 $A/dm^2$ |
|---|---|---|---|---|
| No. 15 | 4.8 | 6.92 | 21.75 | 21.38 |
| No. 16 | 5.7 | 1.80 | 20.95 | 21.03 |
| No. 17 | 5.2 | 0.98 | 22.03 | 21.07 |
| No. 18 | 13.7 | 0.90 | 15.50 | 14.92 |

It is evident from Table 3 that for SiC, particles having a specific surface area reduced to less than 10 $m^2/g$ result in a significant increase in the amount of particles co-deposited.

EXAMPLE 3

A copper plate was dipped in the same composite plating solution as in Example 1 except that SiC powder having a specific surface area of 13.7 $m^2/g$ and a mean particle size of 0.90 μm was dispersed. Composite plating was performed at a cathodic current density of 0.5 $A/dm^2$ to a thickness of 3 μm. Immediately thereafter, the plate was dipped in the same composite plating solution as in Example 1 except that SiC powder having a specific surface area of 5.7 $m^2/g$ and a mean particle size of 1.80 μm was dispersed. Composite plating was again performed at a cathodic current density of 0.5 $A/dm^2$ to a thickness of 3 μm.

The resulting composite deposit had a graded function since it had double coatings, an inside coating having 15.50% by volume of particles and an outside coating having 21.03% by volume of particles.

The co-deposition control method of the present invention assures that the amount of insoluble particles co-deposited in metal matrix is easily controlled over a wide range by adjusting the specific surface area of insoluble particles dispersed in a metal plating solution. This results in a composite deposit having a controlled or optimum amount of insoluble particles co-deposited. The method facilitates formation of a composite deposit having a graded function.

We claim:

1. In a composite plating process comprising the steps of dipping an article in a composite plating solution in the form of a metal plating solution having insoluble particles dispersed therein and forming on the article a composite deposit in which insoluble particles are co-deposited and dispersed in a metal matrix, the improvement comprising the step of adjusting the specific surface area of insoluble particles to be dispersed in the metal plating solution, thereby controlling the amount of insoluble particles co-deposited in the composite deposit.

2. The composite plating process of claim 1 wherein the article is sequentially plated in a plurality of composite plating solutions in which insoluble particles having different specific surface areas are dispersed, thereby forming on the article a corresponding plurality of composite deposits between which the amount of insoluble particles co-deposited is different.

3. A composite plating process comprising the steps of dipping an article in a composite plating solution which comprises a metal plating solution having insoluble particles dispersed therein and forming on the article a composite deposit in which insoluble particles are co-deposited and dispersed in a metal matrix, said insoluble particles having a specific surface area of up to 10 $m^2/g$.

4. The process according to claim 3, wherein said metal plating solution is selected from the group consisting of nickel plating solutions, nickel alloy plating solutions, copper plating solutions, zinc plating solutions, tin plating solutions, and tin alloy plating solutions.

5. The process according to claim 4, wherein said metal plating solution is selected from the group consisting of nickel plating solutions, nickel alloy plating solutions, and copper plating solutions.

6. The process according to claim 3, wherein said insoluble particles are selected from the group consisting of oxides, carbides, nitrides, and organic polymer powders.

7. The process according to claim 6, wherein said oxides are selected from the group consisting of zirconia oxide, alumina oxide, silica oxide, titania oxide, ceria oxide, zinc oxide, and composite oxides thereof.

8. The process according to claim 6, wherein said carbides are selected from silicon carbide, tungsten carbide, and titanium carbide.

9. The process according to claim 6, wherein said nitrides are silicon nitride or boron nitride.

10. The process according to claim 6, wherein said organic polymer powders are selected from the group consisting of fluororesin powder, nylon powder, polyethylene powder, polymethyl methacrylate powder and silicone resin powder.

11. The process according to claim 3, wherein said insoluble particles have a specific surface area in the range from about 0.5 to 10 $mg^2/g$.

12. The process according to claim 11, wherein said insoluble particles have a specific surface area in the range from about 0.5 to 6 $m^2/g$.

13. The process according to claim 3, wherein said insoluble particles have a mean particle size in the range from about 0.1 to 20 μm.

14. The process according to claim 13, wherein said insoluble particles have a mean particle size in the range from about 0.2 to 10 μm.

15. The process according to claim 3, wherein said insoluble particles are contained in said metal plating solution in an amount ranging from 5 to 800 grams/liter.

16. The process according to claim 15, wherein said insoluble particles are contained in said metal plating solution in an amount ranging from 10 to 500 grams/-liter.

17. The process according to claim 3, wherein said composite deposit is formed by an electroplating process.

18. The process according to claim 3, wherein said composite deposit is formed by an electroless plating process.

* * * * *